United States Patent [19]

Ehle et al.

[11] Patent Number: 4,696,013

[45] Date of Patent: Sep. 22, 1987

[54] VESSEL OF A METALLURGICAL FURNACE, ESPECIALLY OF AN ARC FURNACE

[75] Inventors: Joachim Ehle, Lautenbach; Gerhard Fuchs, Kehl-Bodersweier; Klaus Kimmer, Willstätt; Horst-Rüdiger Langfeldt, Baden-Baden, all of Fed. Rep. of Germany

[73] Assignee: Fuchs Systemtechnik GmbH, Willstätt-Legelshurst, Fed. Rep. of Germany

[21] Appl. No.: 905,494

[22] Filed: Sep. 10, 1986

[30] Foreign Application Priority Data

Sep. 21, 1985 [DE] Fed. Rep. of Germany ..... 3533755
Nov. 27, 1985 [DE] Fed. Rep. of Germany ..... 3541873
Mar. 10, 1986 [DE] Fed. Rep. of Germany ..... 3607906

[51] Int. Cl.[4] ..... F27D 1/00; F27D 3/00

[52] U.S. Cl. ..... 373/71; 373/83

[58] Field of Search ..... 373/71, 72, 73, 75, 373/76, 79, 83, 84, 86; 432/106, 211; 266/135

[56] References Cited

U.S. PATENT DOCUMENTS 2,579,885 12/1951 Upper ..... 373/84
4,523,747 6/1985 Schnitzer et al. ..... 373/83
4,552,343 11/1985 Labate, et al. ..... 373/71

*Primary Examiner*—Roy N. Envall, Jr.

[57] ABSTRACT

A furnace vessel (301) of a metallurgical furnace, in particular an electric arc furnace, in which the tap hole (305) is arranged within a lower vessel (303) which is oval or circular in plan view, in the vicinity of the wall of the vessel, and the upper vessel (309), above the tap hole (305), includes a vessel portion (320) which is displaced or is displaceable relative to the lower vessel towards the center of the vessel and in which there is provided a maintenance opening (327) for the tap hole (305) (FIG. 11).

30 Claims, 12 Drawing Figures

VESSEL OF A METALLURGICAL FURNACE, ESPECIALLY OF AN ARC FURNACE

Figure 2:
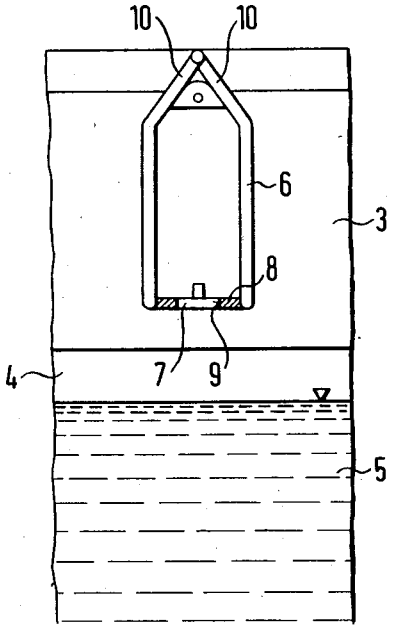

The invention relates to a furnace vessel of a metallurgical furnace, in particular an electric arc furnace, which includes a lower vessel for accommodating a molten metal bath and having a refractory lining and a tap hole which is disposed eccentrically in the floor; an upper vessel which is formed from fluid-cooled wall elements and having a lower edge which is fitted on to the upper edge of the lower vessel; and above the tap hole, a maintenance opening which is closable by a cover.

DE-A1-32 41 987 and EP-A1-0128 965 disclose tiltable furnace vessels of that kind. In such arrangements, the furnace vessel has a bay-like projection portion with a tap opening provided in the floor thereof. The bay-like projection portion permits easy accessibility for the tap hole from the inside of the furnace, by way of a maintenance opening which can be closed by a cover, but it gives rise to constructional difficulties. In order in the tapping process to counteract influences of the tapping flow on the slag floating on the molten metal bath, during the tapping operation, and in order to permit substantially slag-free tapping, the furnace vessel in accordance with EP-A1-0128 965 provides that the bay-like projection portion, with its inner boundary wall, is of an approximately trapezoidal or rectangular configuration in plan view, and the side walls of the bay portion are arranged in a given manner relative to the interior of the furnace, which may be of circular or oval form in plan.

DE-C2-29 21 702 discloses an electrical metal smelting furnace with a stationary furnace vessel, in which at least one tap hole is arranged in the floor of the furnace vessel. The furnace vessel may also be of a shape which differs from a circular shape in plan view, for example it may be of an oval configuration in plan. The upper vessel is of the same plan configuration as the lower vessel. In such a vessel, due to the poor accessibility of the tap hole, the procedure for replacing the tapping passage bricks and filling in the tap hole after the tapping operation, using a filling material, is comparatively expensive.

The object of the present invention, in an electric arc furnace having a furnace vessel of the kind set forth, is to permit easy access to the tap hole for maintenance operations, without having to provide a bay-like projection portion on the furnace vessel. The invention further seeks to provide that that aim can be achieved in existing furnaces by means of simple conversion operations without alterations to the construction for the electrode support mechanism and if possible also the cover construction and the cover support mechanism.

The invention is characterised in that the tap hole is arranged within a lower vessel which is circular or oval in plan, in the region of the longitudinal axis of the oval form of the lower vessel, in the vicinity of the wall of the vessel, and in that the upper vessel, above the tap hole, includes a vessel portion which is displaced or is displaceable relative to the lower vessel towards the center of the vessel and in which maintanance opening is provided.

In the construction according to the invention the tap hole is not disposed in a projecting bay portion of the furnace vessel but in the floor of a lower vessel which is oval or circular in plan view. When the lower vessel is of an oval form, which can be achieved when converting a round lower vessel in an easy manner and without problems in regard to stability, the volume of the vessel is increased in comparison with vessels having an outwardly projecting bay portion, if the overall length of the vessel is taken as the basis for comparison. The portion of the upper vessel in which the maintenance opening is provided and which is displaced or is displaceable with respect to the lower vessel towards the centre of the vessel permits easy access to the tap hole, although the tap hole is disposed not in the region of a bay-like projection portion but within the lower vessel which is of a circular or oval configuration in plan. In a first embodiment of the invention, the vessel portion which is displaced towards the centre of the vessel is in the form of a recess in the upper vessel, the recess projecting into the interior of the vessel and the maintenance opening being provided in the floor thereof. In order to ensure that, when the furnace is charged, charging material does not remain lying on the top of the recess, it is preferably provided with one or more roof-like inclined portions. The recess may be in the form of an inwardly extending bay configuration in at least one of the water-cooled wall elements of the furnace vessel.

In a second embodiment, the upper vessel has a wall element portion which is movable into the interior of the vessel and which in the inwardly moved or displaced condition forms a recess as in the case of the first embodiment and which in the outwardly moved condition, as viewed from the interior of the vessel, provides the usual wall configuration for the upper vessel. Thus, the second embodiment provides the structural configuration in accordance with the first embodiment, only on a temporary basis, that is to say, when access to the tap hole is required for maintenance operations, whereas during the remainder of the period of operation of the furnace, the recess which extends into the interior of the furnace is removed and, in regard to the loading on the wall elements forming the recess, the conditions are the same as in the case of an upper vessel without an inwardly extending bay configuration forming a recess.

With the wall element portion which is movable inwardly of the vessel, the recess form may be produced by the wall element portion having a lower part and side parts which form a shielding with respect to the interior of the furnace vessel when the wall element portion is moved into the interior of the vessel. In that arrangement, the maintenance opening is to be provided in the lower part. The lower part and/or the side parts may be for example made up of cooling pipes and water-cooled. Preferably, the wall element portion is in the form of a pivotal member, while the pivot axis may be arranged horizontally or vertically. A hydraulic cylinder may be used as the drive unit for the pivotal member, one end of the cylinder being secured to thepivotal member and the other end being secured to the upper vessel, preferably to a water cooling ring which extends around the outside at the upper edge of the upper vessel.

In order to prevent the movable wall element portion from becoming baked to the refractory lining of the lower vessel, a preferred construction provides that in the region of the movable wall element portion, the upper end face of the refractory lining of the lower vessel is provided with cooling elements, for example cooling pipes.

Preferably, in the tapping region, the inner upper edge of the refractory lining of the lower vessel is substantially vertically aligned with the inside surface of the wall element of the upper vessel, at that location. That arrangement ensures that slag or charging material cannot be deposited on the upper face of the refractory lining of the lower vessel, and block the movable wall element portion. That feature can be achieved by means of a segment portion of the upper vessel, which is straight in plan view, or by the lower vessel being of a locally, slightly outwardly extended bulge configuration, in the tapping region.

Preferably, the second embodiment also provides that the furnace vessel is of an oval form in plan view, being formed by two semicircular disc portions connected by a rectangular portion.

In a third embodiment of the invention which is particularly suitable for the conversion of existing electric arc furnaces with a vessel of round shape, the lower vessel is oval in plan view and the upper vessel is of a round configuration in plan in the upper part thereof, wherein the portion of the upper vessel which is displaced with respect to the lower vessel above the tap hole is provided by virtue of the centre lines of the oval lower vessel and the round upper vessel being displaced relative to each other.

With a furnace vessel of such a configuration, the volume of the molten bath may be increased when converting an electric arc furnace, more particularly without having to increase the height of the bath, which would result in an increase in the refining time when decarburizing the molten iron bath, without having to alter the cover construction and the construction of the electrode and cover support mechanism. When converting a round furnace vessel, it is only necessary to cut open both the upper vessel and the lower vessel in the middle thereof, fit a vessel portion into position in the lower vessel in order to provide the oval form, and to provide in the upper vessel, in the region above the tap hole, a vessel portion which is displaced towards the centre of the vessel and which can be of a stepped or inclined configuration.

Figure 1:
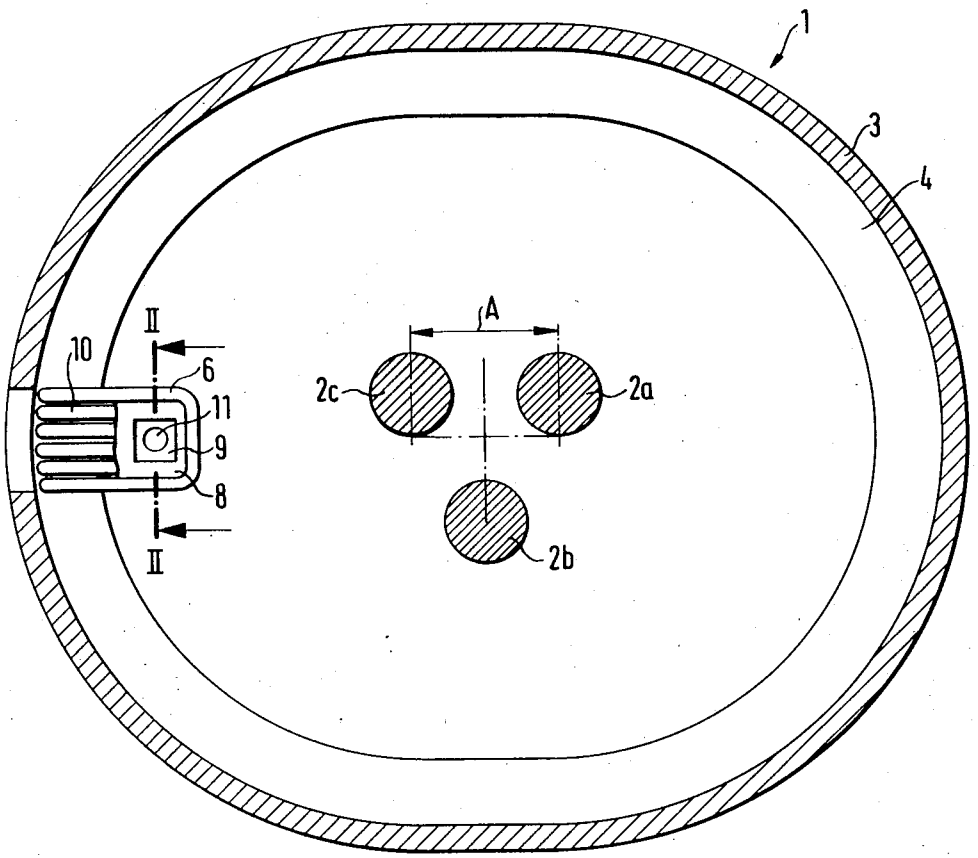
Figure 3:
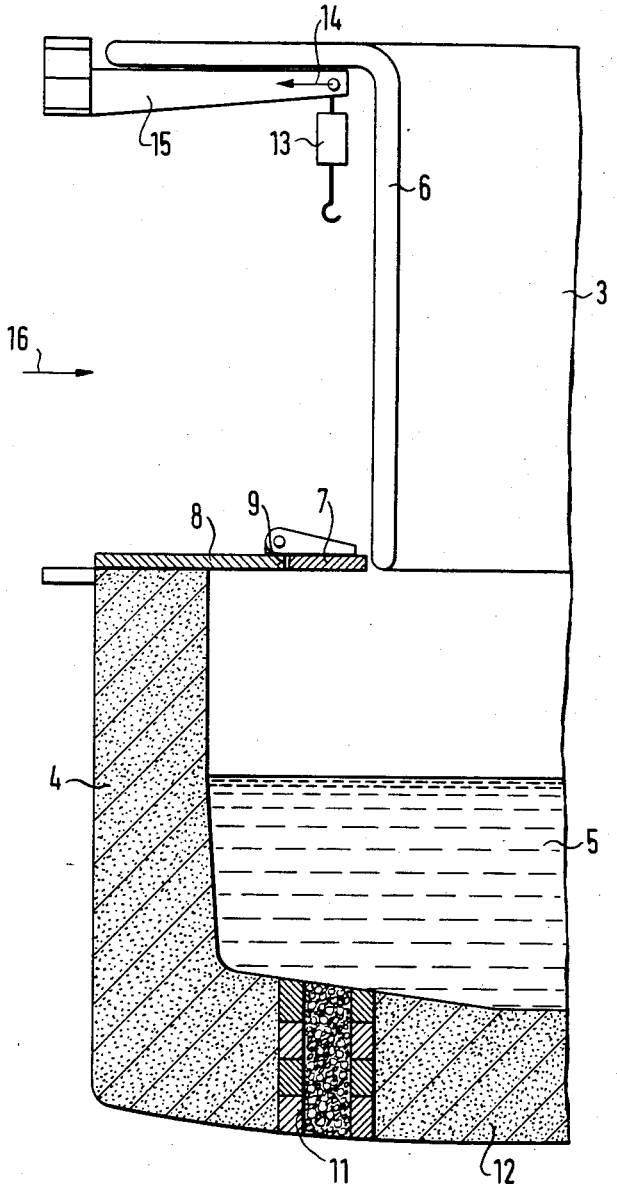
Figure 4:
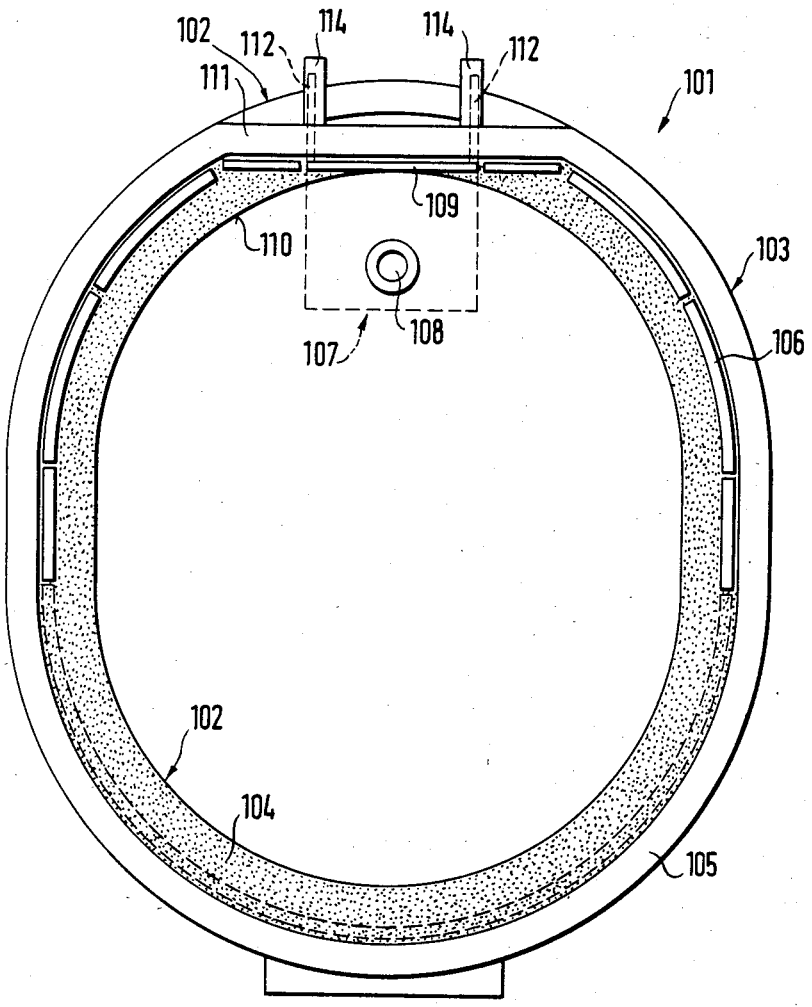
Figure 5:
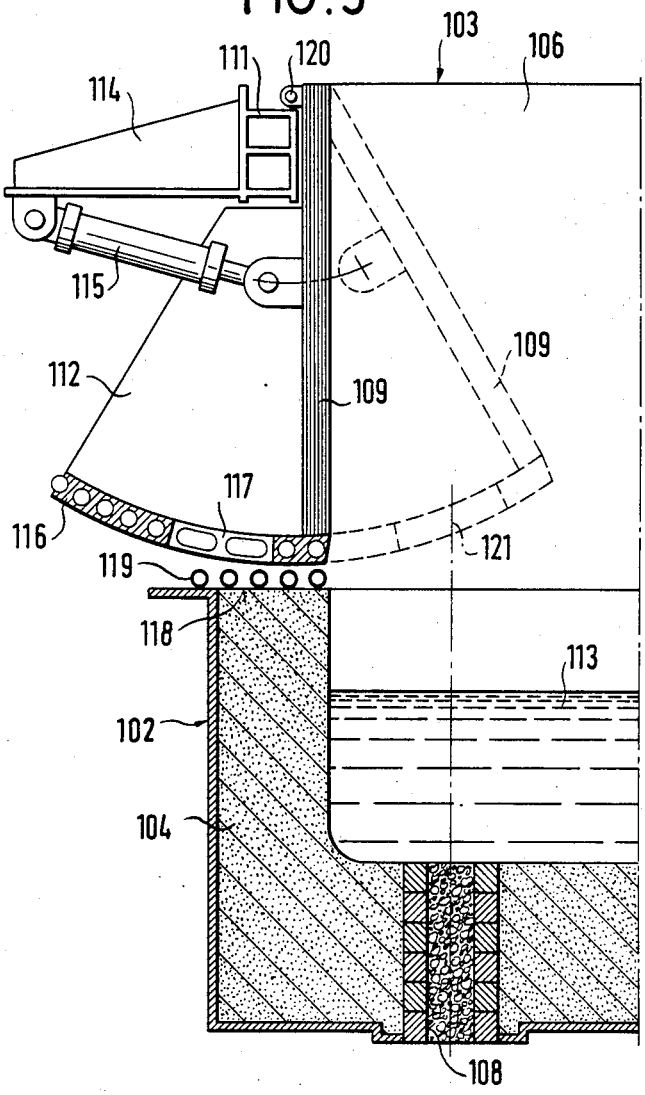
Figure 6:
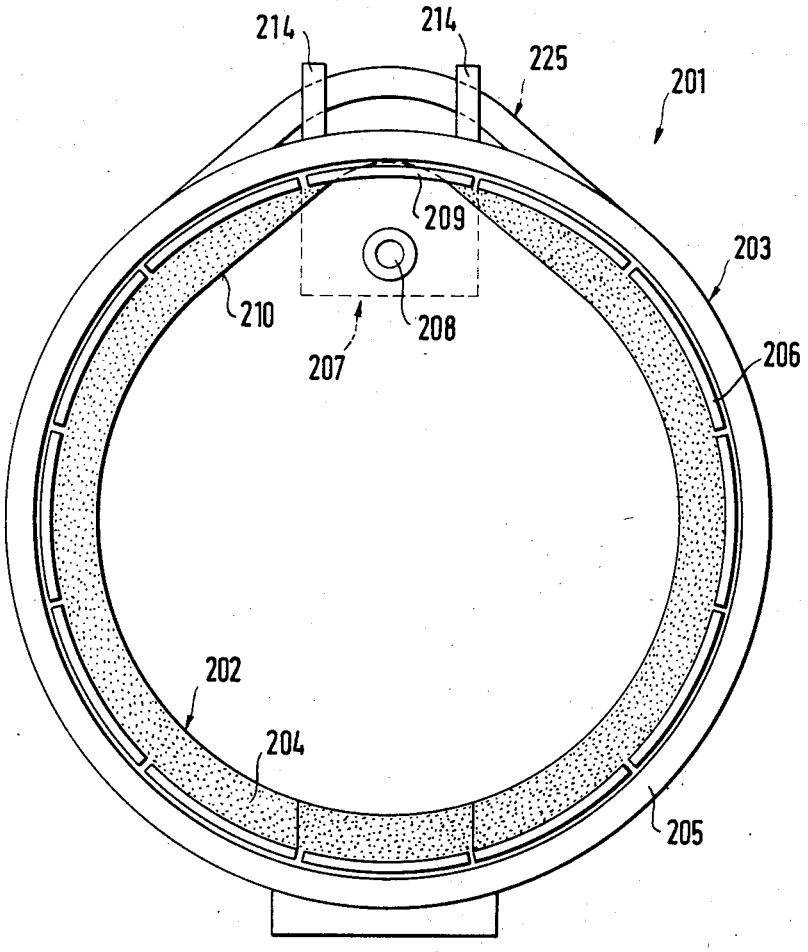
Figure 7:
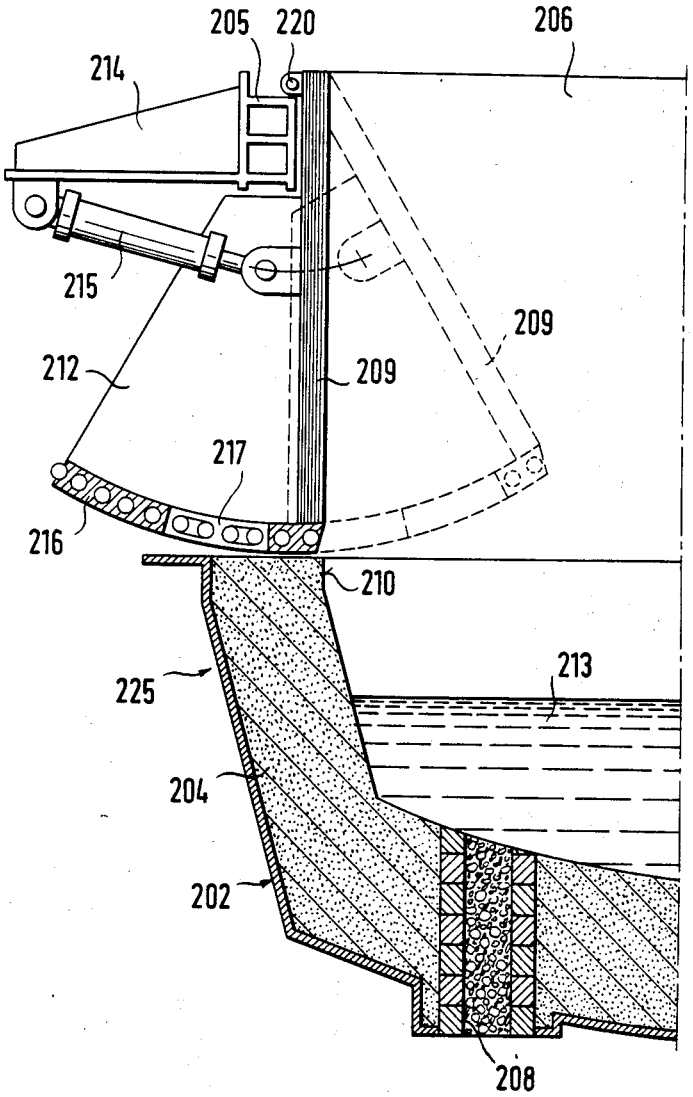
Figure 8:
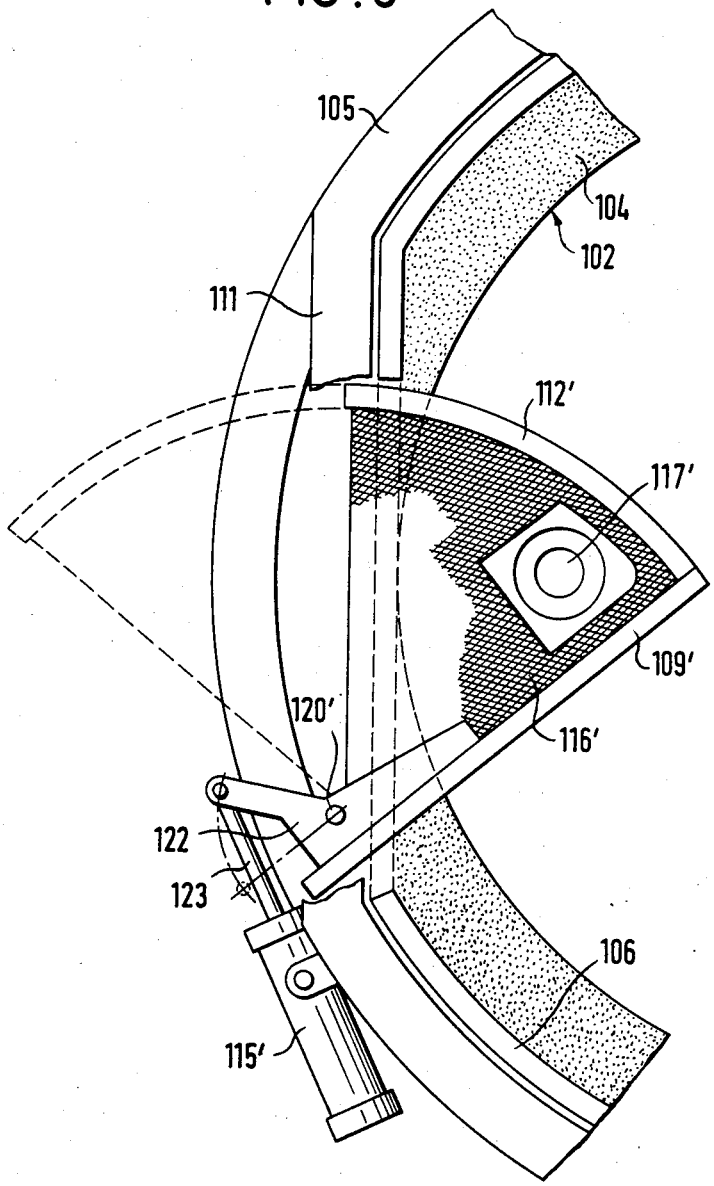
Figure 9:
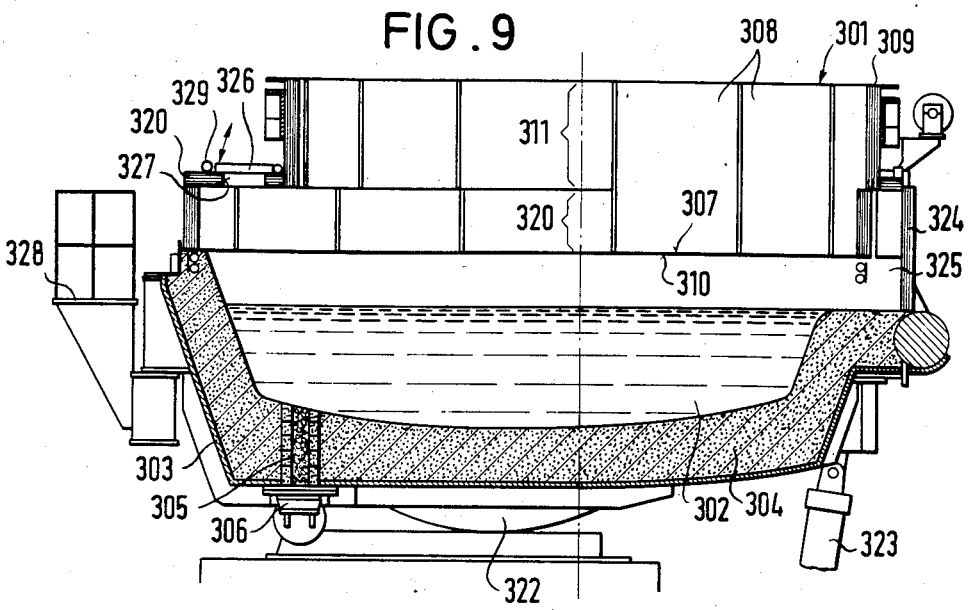
Figure 10:
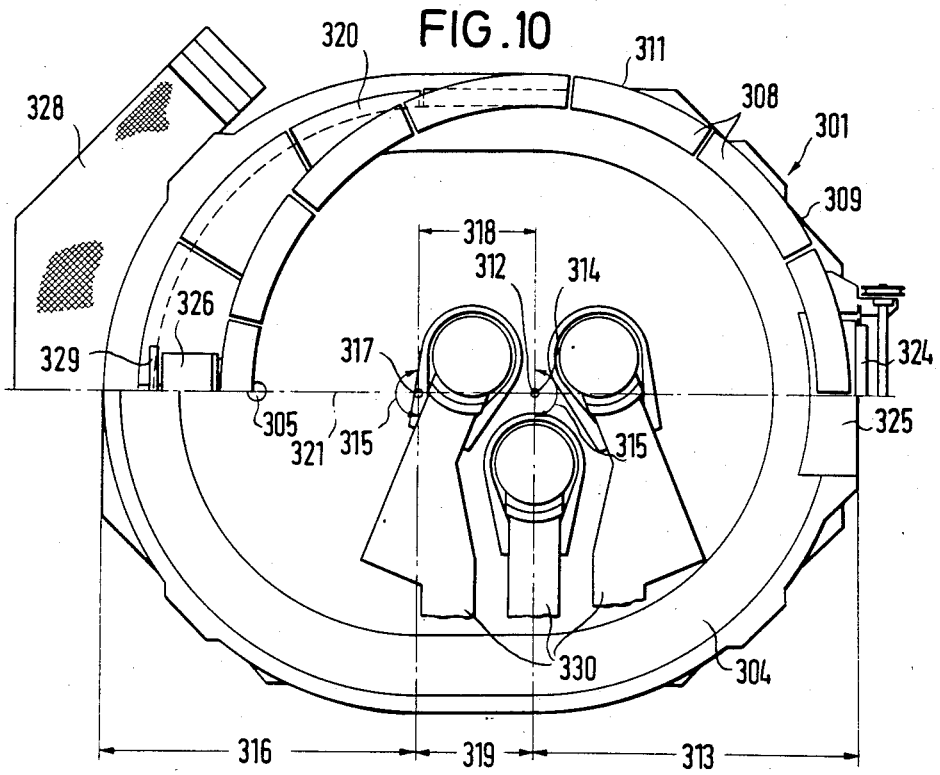
Figure 11:
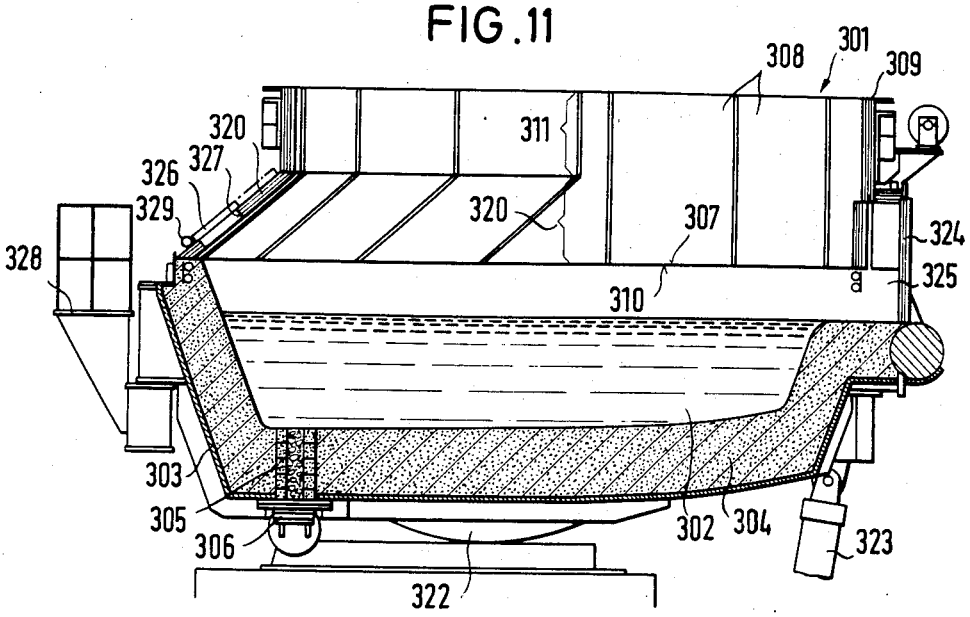
Figure 12:
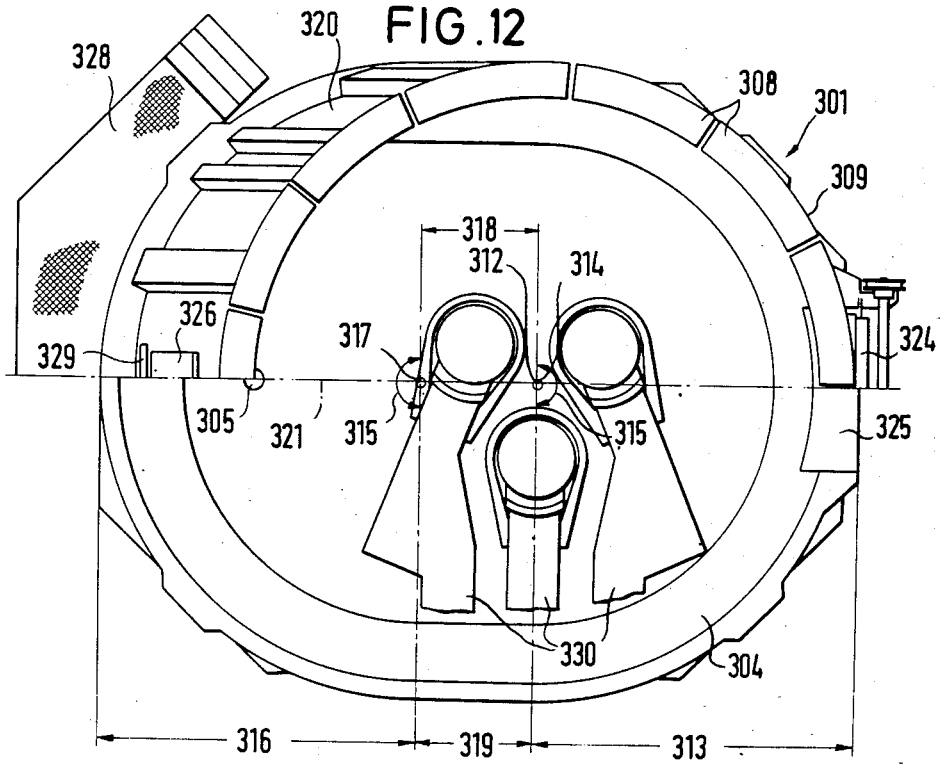

The invention will now be described in greater detail by means of embodiments with reference to 12 figures of drawings in which:

FIG. 1 is a plan view of a furnace vessel of an electric arc furnace, in which the furnace vessel has a recess above the tap hole, FIG. 2 is a view in section taken along line II—II in FIG. 1, FIG. 3 is a diagrammatic view partly in section of part of the furnace vessel shown in FIG. 1, with the plane of the section corresponding to the vertical longitudinal central plane of the furnace vessel, FIG. 4 is a plan view of a furnace vessel in which the upper vessel has a wall element portion which is movable into the interior of the vessel, FIG. 5 is a view partly in section of part of the furnace vessel shown in FIG. 4, FIG. 6 is a plan view of a furnace vessel in a form which is modified in comparison with that shown in FIG. 4, FIG. 7 is a view in partial section corresponding to the view shown in FIG. 5, of the furnace vessel illustrated in FIG. 6, FIG. 8 shows a modified embodiment with a wall element portion which is pivotable about a vertical pivot axis into the interior of the furnace vessel, FIGS. 9 and 10 are a view in longitudinal section and a partly sectional plan view of a furnace vessel in a third fundamental embodiment, and FIGS. 11 and 12 are views corresponding to FIGS. 9 and 10 of an embodiment which is modified in comparison therewith.

Referring firstly to FIG. 1, shown in diagrammatic plan view therein is a tiltable furnace vessel 1 of an electric arc furnace having three electrodes 2*a*, 2*b* and 2*c*. The furnace vessel includes an upper vessel 3 consisting of water-cooled wall elements and a lower vessel 4 which consists of or is lined with refractory material. The cover of the electric arc furnace, the electrode support arms and other parts of the furnace are not shown in the drawings.

As shown in FIG. 1, the furnace vessel 1 is substantially oval in plan view. Strictly speaking, the configuration in plan view of the furnace vessel 1 corresponds to the combination of a rectangular middle portion with two semicircular disc portions, the length of the rectangular portion between the semicircular disc portions being indicated by the double-headed arrow A in FIG. 1. The length A substantially corresponds to the mutual spacing of the centre lines of the electrodes. The electrodes are disposed centrally with respect to the middle of the vessel, as shown in FIG. 1.

FIG. 3 shows a diagrammatic view in section through the furnace vessel. Disposed in the floor 12 of the lower vessel 4, in the vicinity of the edge of the vessel, is a tap hole 11. Closure means for closing off the tap hole are not illustrated herein. The furnace vessel is mounted in such a way that it can be tilted.

Above the tap hole 11, the upper vessel 3 has a recess 6 which extends into the interior of the vessel. The recess 6 is formed by an inwardly extending bay configuration in one or more water-cooled wall elements of the upper vessel 3. The top side of the recess 6 is formed by two inclined portions 10 in a roof-like form. The underside of the recess 6 is formed, towards the molten metal 5 (see FIG. 2), by a water-cooled floor 8 in which a maintenance opening 9 is formed, in vertical alignment with the tap hole 11. The maintenance opening 9 can be closed by a cover 7. The underside of the recess 6 is disposed at about 600 to 1200 mm above the maximum admissible level of the surface of the molten metal bath.

Access to the tap hole 11 is possible from the outside of the upper vessel 3, as indicated by an arrow 16 in FIG. 3. As the underside of the recess 6 is at a relatively small distance from the tap hole 11, the tap hole 11 is easily accessible.

Reference numeral 13 denotes an electrical lifting apparatus which is displaceable by means of rollers in the direction indicated by arrow 14, along a rail 15 which is secured to the upper vessel. The electrical lifting apparatus 13 makes it possible for the cover 7 or the water-cooled floor 8 to be lifted up and removed, as well as permitting new wearing tubes to be fitted into the tap hole 11.

FIG. 4 shows a plan view of a furnace vessel 101 of an electric arc furnace. Like FIGS. 1 through 3, FIG. 4 and also FIGS. 5 through 8 do not show parts of the electric arc furnace which are not of major interest in this connection, such as for example the furnace cover, the electrodes with the electrode support arms, a closure means for closing the tap hole in the floor of the furnace, and the like.

The furnace vessel 101 is of substantially oval cross-section. More precisely, the plan-view configuration of the vessel 101 corresponds to two semicircular disc portions which are connected together by way of a rectangular portion.

The furnace vessel 101 has a lower vessel 102 which is lined with a refractory lining 104. As shown in FIG. 4, the upper end face of the lining 104 is free. Adjoining the lower vessel in an upward direction in that region is an upper vessel 103. The inside of the upper vessel 103 is lined with straight and curved, water-cooled wall elements 106. A water cooling ring 105 extends around the upper vessel 103 at the upper outer edge thereof. The connections for the water cooling circuit are not illustrated herein.

Disposed in the region of the narrow side of the furnace vessel 101, as shown in FIG. 4 at the top thereof, is a tapping region 107 which is illustrated by broken lines and in which a tap opening 108 is disposed in the floor of the vessel (see FIG. 5).

The configuration of the upper vessel 103 in plan view substantially corresponds to that of the lower vessel 102, but in the tapping region 107 the upper vessel 103 is of a non-round, straight form. For that purpose, the water cooling ring 105 which extends around the upper vessel 103 has an elongate straight portion 11. In that region, the water-cooled wall elements of the upper vessel 103 are in the form of flat plates. A water-cooled wall element 109 is arranged to be pivotable towards the centre of the furnace, in a manner which will be described in greater detail hereinafter. At its outwardly facing edges, the wall element 109 carries side parts 112 of which one is shown in FIG. 5.

FIG. 5 shows the details of the wall element 109 which is pivotable towards the middle of the furnace, and the parts of the furnace vessel which are related to that wall element. Pivotal movement of the wall element 109 into the position shown in broken lines in FIG. 5 permits access to be had to the tap hole 108 in the floor of the lower vessel 102, for which purpose the arrangement includes a maintenance opening which is described in greater detail hereinafter.

Adjoining the two lateral edges of the wall element 109 are water-cooled side parts 112 which are of a substantially trapezoidal cross-section, while adjoining the lower edge of the wall element 109 is a lower part 116 which is of an arcuate cross-sectional configuration and which consists of cooling pipes. Formed in the lower part 116 is a maintenance opening 117 which is substantially square or circular; when the wall element 109 is pivoted towards the middle of the vessel, the middle of the maintenance opening 117 approximately coincides with a perpendicular line 121 through the tap hole 108.

The water-cooled wall element 109 and the side parts 112 which adjoin same in an outward direction, as well as the lower part 116 thereof, form a shielding means with respect to the interior of the furnace vessel when operations are being carried out at the tap hole 108. Such operations are for example cleaning the tap hole when there is no longer any molten metal 113 in the lower vessel, or when all that remains in the lower vessel is a metal sump.

In the embodiment shown in FIG. 5, the pivotal member 109, 112 and 116 is mounted on a horizontal pivot axis 120 mounted at the upper outer edge of the upper vessel 103. At its outward side, the straight portion 111 of the water cooling ring which extends around the upper vessel 103 at the upper edge thereof carries two mounting arms 114. Pivotally connected to the outer end of each thereof is a respective stroke-motion cylinder 115 having a piston rod which is pivotally connected to the outside of the wall element 109. Actuation of the cylinders 115 causes the pivotal member to pivot about the horizontal axis 120 between the position shown in solid lines in FIG. 5 on the one hand and the position shown in broken lines in FIG. 5 on the other hand.

In order to prevent the lower part 116 of the wall element 109 from becoming baked to the top of the refractory lining 104, copper cooling pipes 119 are provided in the region of the wall element 109 on the upper face 118 of the lining 104.

As shown in FIG. 5, the lower vessel 102 has vertical side walls in the tapping region 107. In that area, the inside surface of the wall element 109 is aligned with the upper inner edge 110 of the vertical lining 104.

FIG. 6 shows a further embodiment of the invention. Components which are the same or similar to those appearing in FIG. 4 are denoted by the same reference numerals increased by 100. Components which have already been described will not be described again at this stage. The main difference between the embodiment shown in FIG. 4 and the embodiment shown in FIG. 6 is that, in FIG. 6, the furnace vessel 201 is of a round cross-section and only in the tapping region 207 the lower vessel has an outwardly extending bulge portion 225 which projects outwardly to such a degree that the inside of the water-cooled wall element 209 at that location aligns with the upper inner edge 210 of the refractory lining 204, in a similar manner to the embodiment shown in FIG. 4. That arrangement means on the one hand it is possible to forego an upper covering means for the outwardly extending portion of the lower vessel, while on the other hand it eliminates, at the transition from the upper vessel to the lower vessel, a step on which slag could stick.

FIG. 7 is a view corresponding to that shown in FIG. 5, of a furnace vessel of the kind illustrated in FIG. 6. The side wall of the lower vessel 202 is inclined, in the form of an outwardly extending bulge portion 225. The upper inner edge 210 thereof is aligned with the inside surface of the pivotal wall element 209.

The embodiment shown in FIG. 7 does not have the cooling pipes illustrated in FIG. 5, on the end face of the lining of the lower vessel.

In the embodiments illustrated in FIGS. 4 through 7, the wall element 109 or 209 respectively, with its parts adjoining same in an outward direction, is pivoted about a horizontal pivot axis at the upper outer edge of the furnace vessel. FIG. 8 shows an embodiment which uses a vertical pivot axis 120'.

Referring to FIG. 8, the pivotal member which is provided for access to the tap hole comprises the water-cooled wall element 109' which is pivotable horizontally about the vertical pivot axis 120' and which at the same time forms a side part of the pivot member, a side portion 112' which is of an arcuate configuration in cross-section, a flat lower part 116' in which a maintenance opening 117' is formed, and an upper part which is not shown but which corresponds in form to the lower part. Secured to the water cooling ring 105 which extends around the outer periphery of the upper vessel is a hydraulic cylinder 115' having a piston rod 123 which is connected to the outer end of a plate 122 welded to the outside of the wall element 109'. The plate 122, together with a further plate (not shown)

which is arranged in parallel relationship therewith and at a spacing therefrom, mounts the vertical pivot axis 120'.

In the embodiments described with reference to FIGS. 4 through 8, the pivotal member which is pivotable about a horizontal or a vertical axis permits access to the tap hole n the floor of the vessel. The lower and side parts which are connected to the pivotable wall element 109 or 109', provide a cooled and cooling shielding means with respect to the interior of the vessel. Under normal smelting operating conditions, the pivotal member is pivoted back outwardly so that the pivotable wall element 109 or 109' fits into the array of the other water-cooled wall elements 106 or 206 respectively of the upper vessel.

The furnace vessel 301 shown in FIGS. 9 and 10, of an electric arc furnace, includes a lower vessel 303 which has a refractory lining 304, for accommodating a molten metal bath 302, and a tap hole 305 which is arranged eccentrically in the floor of the vessel and which is closed at its underneath by a closure member 306. The closure member 306 can be pivoted from the closing position shown in FIG. 9 into an open position in which it opens the tap hole 305.

An upper vessel 309 which is formed from fluid-cooled wall elements 308 is fitted by means of its lower edge 310 on to the upper edge 307 of the lower vessel 303. The upper vessel 309 has a first upper vessel portion 311 which in plan view (see FIG. 10) is in the form of a circular ring, with a first centre point 312 of the circle. The lower vessel 303 comprises a second vessel portion 313 which in plan view is in the form of a sector of a circular ring, with a second centre point 314 which coincides with the first centre point 312. In the illustrated structure, the angle at the centre of the sector of the circular ring, as indicated at 315, is 180°, that is to say, the sector of the circular ring is in the form of a semicircular ring sector. The angle 315 should be between 120° and 180°.

The lower vessel 303 also has a third vessel portion 316 which in plan view, as shown in FIG. 10, like the second vessel portion 313, is in the form of a sector of a circular ring, with an angle at the centre of 180°, with the third vessel portion 316 being disposed in opposite relationship to the second vessel portion 313. Associated with the third vessel portion 316 is a third centre point 317 of the circle, the centre point 317 being displaced outwardly by a distance 318 relative to the second centre point 314.

Finally, the lower vessel 303 also has a fourth vessel portion 319 which, in the plan view shown in FIG. 10, provides a rectilinear connection between the second and third vessel portions 313 and 316 so that the upper edge 307 of the lower vessel 303 is oval in shape, as can be seen from FIG. 10. If the angle 315 is less than 180°, then, in order to ensure a smooth transition, it is desirable for the fourth vessel portion 319, as considered in plan view, to connect the second and third vessel portions in each case with a slight outward curvature. That situation is not illustrated.

The upper vessel 309 further comprises a fifth lower vessel portion 320 whose lower edge 310 is adapted to the oval configuration of the upper edge 307 of the lower vessel 303.

As viewed in plan (see FIG. 10), the tap hole 305 is disposed on the longitudinal axis 321 of the oval lower vessel 303 and is located in the vicinity of the wall of the vessel. The furnace vessel can be tilted in the direction of the longitudinal axis of the oval lower vessel. For that purpose, the assembly comprises a furnace cradle 322 and a hydraulic cylinder 323. A working opening 325 which can be closed by a door 324 is disposed in the wall of the furnace vessel on the side thereof which is opposite to the tap hole 305.

In the part shown on the right in FIGS. 9 and 10, the fifth vessel portion 320 is cylindrical in the same manner as the first vessel portion 311, while it is of a stepped configuration in the region shown at the left in FIGS. 9 and 10, that is to say, in the transitional region from the first vessel portion to the third and fourth vessel portions. In the plan view shown in FIG. 10, the above-mentioned step-like fifth vessel portion represents a circular sickle-shaped area.

Disposed inclinedly above the tap hole 305, in the fifth vessel portion, is a maintenance opening 327 which permits access to the tap hole 305 and which can be closed by a cover 326. The maintenance opening can also be used for example after the tapping operation to fill the tap hole 305 by means of pourable refractory material. In order to provide protection for the operator who can reach the maintenance opening 327 by way of an operating platform 328, from the hot gases which issue from the maintenance opening 327, a pipe 329 is disposed along one edge of the maintenance opening, the pipe 329 having outlet openings which are directed inwardly at an inclined angle with respect to the plane of the maintenance opening 327. The pipe 329 produces gas jets which are directed inclinedly into the interior and which act as a curtain to prevent the hot furnace gases from escaping.

The embodiment shown in FIGS. 11 and 12 differs from the embodiment shown in FIGS. 9 and 10 in that the fifth vessel portion 320 is not of a step-like configuration but is of an inclined configuration, in the transitional region from the first vessel portion to the third and fourth vessel portions. With such a design configuration, while maintaining an adequate safety distance for the liquid-cooled elements of the upper vessel from the region of the molten metal bath which is above the tap hole and in which eruptions can occur, the spacing between the maintenance opening 327 and the tap hole 305 can be reduced and thus accessibility to the tap hole can be improved. In that construction, increased significance is attributed to the pipe 329 for producing a curtain of gas. Moreover, in this embodiment (see FIG. 11), the floor of the vessel is of such a configuration as to fall away towards the tap hole 305 so that there is no need for the vessel to be tilted in the tapping operation.

As shown in FIGS. 10 and 12, the elecrode support arms 330 extend transversely with respect to the longitudinal axis 321 of the oval lower vessel. It will also be seen from those Figures that the upper edge of the upper vessel is in the form of a circular ring. That means that the furnace according to the invention does not differ from a round furnace, in regard to the cover and the electrode support arms as well as the cover support mechanism (not shown), and that when a round furnace is converted, the cover, the cover support mechanism and the electrode support mechanism remain unaltered. Nonetheless, with the furnace according to the invention, converting the lower vessel from a round form into an oval form provides that the volume of the bath and at the same time the surface area thereof can be increased by about one third if, as in the illustrated situation, the spacing 318 between the centre points 314 and 317 is approximately the spacing between the axes of the electrodes. As not just the volume of the bath but also the surface area thereof is increased, the necessary refining time is not increased that is to say, the increase in volume does not involve any disadvantages from the point of view of operating procedure.

When converting a round furnace vessel, it is sufficient for both the upper vessel and the lower vessel to be cut open at the centre, for the vessel portion 319 to be fitted into the lower vessel between the third and fourth vessel portions 313 and 316 respectively, and to provide a vessel portion 320 which is of an inclined or stepped configuration, in the upper vessel, in the transitional region from the first vessel portion 311 to the third and fourth vessel portions 316 and 319 respectively. Although the furnace vessel according to the invention does not have a bay-like projection portion, it affords access to the tap hole by way of the wall of the furnace vessel, while the distance relative to the water-cooled elements in the endangered area above the tap hole is increased, in comparison with a bay-like projection portion.

We claim:

1. A furnace vessel of a metallurgical furnace, in particular an electric arc furnace comprising:

(a) a lower vessel, oval in plan, for accommodating a molten metal bath and having a refractory lining, a floor, and a tap hole disposed eccentrically in the floor; the tap hole being arranged within the lower vessel in the region of the longitudinal axis of the oval in the vicinity of the wall of the vessel;

(b) an upper vessel formed from fluid-cooled wall elements and having a lower edge which is fitted on to an upper edge of the lower vessel; the upper vessel, above the tap hole, including an upper vessel portion which is displaced relative to the lower vessel towards the center of the vessel; and (c) a maintenance opening located above the tap hole in said upper vessel portion and closable by a cover.

2. A furnace vessel of a metallurgical furnace, in particular an electric arc furnace comprising:

(a) a lower vessel, oval in plan, for accommodating a molten metal bath and having a refractory lining, a floor, and a tap hole disposed eccentrically in the floor; the tap hole being arranged within the lower vessel in the region of the longitudinal axis of the oval in the vicinity of the wall of the vessel;

(b) an upper vessel formed from fluid-cooled wall elements and having a lower edge which is fittd on to an upper edge of the lower vessel; the upper vessel, above the tap hole, including an upper vessel portion which is displaceable relative to the lower vessel towards the center of the vessel; and (c) a maintenance opening located above the tap hole in said upper vessel portion and closable by a cover.

3. A furnace vessel of a metallurgical furnace, in particular an electric arc furnace, comprising:

(a) a lower vessel, circular in plan, for accommodating a molten metal bath and having a refractory lining, a floor, and a tap hole disposed eccentrically in the floor; the tap hole being arranged within the lower vessel in the vicinity of the wall of the vessel;

(b) an upper vessel formed from fluid-cooled wall elements and having a lower edge which is fitted on to an upper edge of the lower vessel; the upper vessel, above the tap hole, including an upper vessel portion which is displaced relative to the lower vessel towards the center of the vessel; and (c) a maintenance opening above the tap hole in said upper vessel portion and closable by a cover.

4. A furnace vessel of a metallurgical furnace, in particular an electric arc furnace, comprising:

(a) a lower vessel, circular in plan, for accommodating a molten metal bath and having a refractory lining, a floor, and a tap hole disposed eccentrically in the floor; the tap hole being arranged within the lower vessel in the vicinity of the wall of the vessel;

(b) an upper vessel rormed from fluid-cooled wall elements and having a lower edge which is fitted on to an upper edge the lower vessel; the upper vessel, above the tap hole, including an upper vessel portion which is displaceable relative to the lower vessel towards the center of the vessel; and (c) a maintenance opening above the tap hole in said upper vessel portion and closable by a cover.

5. A vessel as set forth in claim 1 or 3, wherein above the tap hole the upper vessel has a recess, the maintenance opening being provided in a floor of the recess.

6. A vessel as set forth in claim 5, wherein the recess has a top side provided with at least one roof-like inclined portion.

7. A vessel as set forth in claim 5, wherein the recess is in the form of an inwardly extending bay configuration in at least one of the water-cooled wall elements of the upper vessel.

8. A vessel as set forth in claim 1 or 2, wherein the lower vessel, in plan, includes two semicircular portions connected by a rectangular portion, and the tap hole is arranged at an edge of the vessel.

9. A vessel as set forth in claim 2 or 4, wherein in a region above the tap hole, the upper vessel has a wall element portion which is movable into the interior of the vessel to a position above the tap hole.

10. A vessel as set forth in claim 9, wherein the movable wall element portion has a lower part and side parts which form a shielding means with respect to the interior of the furnace vessel when the wall element portion has been moved towards the interior of the vessel, and the maintenance opening being provided in the lower part.

11. A vessel as set forth in claim 9, wherein the movable wall element portion is a pivotal member.

12. A vessel as set forth in claim 11, wherein a hydraulic cylinder is connected as a drive unit to the pivotal member, the hydraulic cylinder being supported on the upper vessel.

13. A vessel as set forth in claim 11, wherein the pivot axis of the pivotal member is arranged horizontally.

14. A vessel as set forth in claim 11, wherein the pivot axis of the pivotal member is arranged vertically, while the wall element in the region above the tap hole forms a side part of the pivotal member.

15. A vessel as set forth in clam 9, wherein in the region of the movable wall element portion an upper end face of the refractory lining of the lower vessel is provided with cooling elements.

16. A vessel as set forth in claim 9, wherein in the region above the tap hole the inner edge of the refractory lining of the lower vessel is substantially aligned vertically with the inside surface of the wall element, disposed at that location, of the upper vessel.

17. A vessel as set forth in claim 8, wherein in a region above the tap hole, at a narrow side of the vessel, the upper vessel has a segment portion which is straight in plan view.

18. A vessel as set forth in claim 3 or 4, wherein the lower vessel has an outwardly extending bulge portion in the region above the tap hole.

19. A vessel as set forth in claim 1, wherein the upper vessel has a first upper vessel portion which in plan view is in the form of a circular ring, with a first center point of the circle;

the lower vessel has a second vessel portion which in plan view is in the form of a sector of a circular ring, having a second center point of the circle, which coincides with the first center point;

the lower vessel has a third vessel portion which in plan view like the second vessel portion is in the form of a sector of a circular ring and is disposed in opposite relationship thereto, with a third center point of the circle, which is displaced outwardly with respect to the second center point;

the lower vessel has a fourth vessel portion which in plan view joins the second and third vessel portions in a rectilinear or slightly outwardly curved configuration, so that the upper edge of the lower vessel is of an oval form; and the upper vessel has a fifth vessel portion whose lower edge is adapted to the oval form of the upper edge of the lower vessel, which includes the maintenance opening and whose upper edge is connected to the first upper vessel portion.

20. A vessel as set forth in claim 19, wherein the second and third vessel portions are in the form of sectors of a semicircular ring, in plan view.

21. A vessel as set forth in any one of claims 1, 2, 19 or 20, wherein the vessel is tiltable in the direction of the longitudinal axis of the oval vessel.

22. A vessel as set forth in claim 19 or 20, wherein the fifth vessel portion is of a stepped configuration in a transistional region from the first vessel portion to the third and fourth vessel portions.

23. A vessel as set forth in claim 19 or 20, wherein the fifth vessel portion is of an inclined configuration in the transitional region from the first vessel portion to the third and fourth vessel portions.

24. A vessel as set forth in claim 19 or 20, wherein at least along one edge of the maintenance opening there is disposed a pipe having outlet openings which are directed inwardly inclinedly with respect to the plane of the maintenance opening.

25. A vessel as set forth in claim 22, wherein at least along one edge of the maintenance opening there is disposed a pipe having outlet openings which are directed inwardly inclinedly with respect to the plane of the maintenance opening.

26. A vessel as set forth in claim 19 or 20 in combination with an electric arc furnace including three electrodes which are disposed in a triangular array in plan view, the spacing between the second and third center points substantially corresponding to the spacing between center lines of the three electrodes.

27. A vessel as set forth in claim 22 in combination with an electric arc furnace including three electrodes which are disposed in a triangular array in plan view, the spacing between the second and third center points substantially corresponding to the spacing between center lines of the three electrodes.

28. A vessel as set forth in any one of claims 1, 2, 19 or 20, in combination with an electric arc furnace having electrode support arms which are arranged transversely with respect to the longitudinal axis of the oval lower vessel.

29. A vessel as set forth in claim 22, in combination with an electric arc furnace having electrode support arms which are arranged transversely with respect to the longitudinal axis of the oval lower vessel.

30. A vessel as set forth in claim 26, in combination with an electric arc furnace having electrode support arms which are arranged transversely with respect to the longitudinal axis of the oval lower vessel.

* * * * *